US006680281B2

(12) United States Patent
Tajiri et al.

(10) Patent No.: US 6,680,281 B2
(45) Date of Patent: Jan. 20, 2004

(54) HEAT-SENSITIVE RECORDING MATERIAL

(75) Inventors: Masanao Tajiri, Amagasaki (JP); Takashi Umemoto, Amagasaki (JP); Shigeru Suzuki, Amagasaki (JP); Rie Harunaga, Amagasaki (JP)

(73) Assignee: Oji Paper Co., Ltd., Tokyo (JP)

( * ) Notice: Subject to any disclaimer, the term of this patent is extended or adjusted under 35 U.S.C. 154(b) by 205 days.

(21) Appl. No.: 09/866,812

(22) Filed: May 30, 2001

(65) Prior Publication Data

US 2002/0006869 A1 Jan. 17, 2002

(30) Foreign Application Priority Data

Jun. 1, 2000 (JP) ..... 2000-164406
Jun. 8, 2000 (JP) ..... 2000-171891

(51) Int. Cl.[7] ..... B41M 5/30

(52) U.S. Cl. ..... 503/209; 503/204; 503/215; 503/216

(58) Field of Search ..... 503/215, 216, 503/209, 204, 200, 226

(56) References Cited

U.S. PATENT DOCUMENTS 5,801,288 A * 9/1998 Fujii et al. ..... 568/33

FOREIGN PATENT DOCUMENTS

| | | | |
|---|---|---|---|
| EP | 0 774 363 | A1 | 5/1997 |
| JP | 142025 | A | 6/1997 |
| JP | 263057 | A | 10/1997 |
| JP | 290565 | A | 11/1997 |
| WO | 00/35679 | | 6/2000 |

OTHER PUBLICATIONS

"Heat Sensitive Recording Material" Research Disclosure., vol. 433, No. 10, May 2000, pp. 842–846, XP000976661, Kenneth Mason Publications, Hampshire., GB, ISSN: 0374–4353.

* cited by examiner

*Primary Examiner*—Bruce Hess
(74) *Attorney, Agent, or Firm*—Kubovcik & Kubovcik

(57) ABSTRACT

Disclosed is a heat-sensitive recording material comprising a support and a heat-sensitive coloring layer formed on the support, wherein the heat-sensitive coloring layer contains either composite particles in which a leuco dye is contained in solid resin particles or microcapsules in which a leuco dye and a hydrophobic organic solvent are contained, the heat-sensitive coloring layer optionally contains other leuco dye which forms a color different from the color formed by the leuco dye contained in the composite particles or in the microcapsules, and the developer is N-p-toluenesulfonyl-N'-3-(p-toluenesulfonyloxy)phenylurea.

19 Claims, No Drawings

HEAT-SENSITIVE RECORDING MATERIAL

TECHNICAL FIELD

The present invention relates to a heat-sensitive recording material which makes use of a color forming reaction between a leuco dye and a developer.

BACKGROUND ART

Heat-sensitive recording materials are well known which make use of the color forming reaction of a lueco dye with a color-developer which develops a color on contact with the leuco dye, such that the two materials are brought into contact with each other by heating to produce a color image. These heat-sensitive recording materials are relatively inexpensive, and recording devices for these materials are compact and relatively easy to maintain. Consequently such recording materials are widely used as recording media for facsimile systems, word processors, various computers and other application.

With the expansion of the scope of application of such heat-sensitive recording materials, diversified performances are demanded, such as enhanced sensitivity of the heat-sensitive recording layer, improved chemical resistance of the recorded portions (=recorded images), stability of the recorded portions with time, capability of multi-color recording of the heat-sensitive recording materials, etc.

The heat-sensitive recording materials in which a leuco dye is contained in microcapsules to enhance resistance of the recorded portions to chemicals or resistance to background fogging are disclosed in Japanese Unexamined Patent Publications Nos. 12695/1982, 214691/1984, 214990/1985, 247987/1992, etc.

Japanese Unexamined Patent Publications Nos. 142025/1997, 263057/1997 and 290565/1997 disclose heat-sensitive recording materials capable of forming distinct multi-color images by using a composite of a leuco dye and a resin.

With these heat-sensitive recording materials as well, further improvement in resistance to chemicals and resistance to background fogging is demanded.

Accordingly, an object of the present invention is to provide a heat-sensitive recording material which is excellent in preservability of the recorded portions and resistance to background fogging.

SUMMARY OF THE INVENTION

As a means for achieving the above object, in a heat-sensitive recording material comprising a support and a heat-sensitive coloring layer formed on the support and containing a leuco dye and a developer, the present invention utilizes, in the heat-sensitive coloring layer, either composite particles each containing a leuco dye in solid resin particle or microcapsules containing a leuco dye and a hydrophobic organic solvent, and N-p-toluenesulfonyl-N'-3-(p-toluenesulfonyloxy)phenylurea as a color developer.

Particularly, the present invention provides a heat-sensitive recording material which comprises a support and a heat-sensitive coloring layer formed on the support and containing a leuco dye and a developer, wherein the leuco dye is either (a) in the form of composite particles each of which contains the leuco dye in a solid resin particle or (b) contained in microcapsules in which a hydrophobic organic solvent is contained, and the developer is N-p-toluenesulfonyl-N'-3-(p-toluenesulfonyloxy)phenylurea.

Further, a heat-sensitive recording material capable of multi-color recording can be obtained by incorporating into the heat-sensitive coloring layer another leuco dye which forms a color different from that formed by the above leuco dye which is in the form of composite particles or contained in microcapsules.

DETAILED DESCRIPTION OF THE INVENTION

In the heat-sensitive coloring layer, the amount of the composite particles containing a leuco dye in solid resin particles or the amount of microcapsules containing a leuco dye and a hydrophobic organic solvent, and the amount of N-p-toluenesulfonyl-N'-3-(p-toluenesulfonyloxy) phenylurea (hereinafter referred to as "a specific developer") are not specifically limited.

Generally, the amount of said composite particles or said microcapsules is preferably about 5 to about 70% by weight, more preferably about 10 to about 40% by weight, based on the total amount of solids in the heat-sensitive coloring layer (including the amount of the hydrophobic organic solvent in the microcapsules when the microcapsules are used; the same applies hereinafter). The amount of the specific developer is preferably about 5 to about 60% by weight, more preferably about 10 to about 40% by weight, based on the total amount of solids in the heat-sensitive coloring layer.

Composite Particles

Composite particles in which a leuco dye is contained in solid resin particles are known and disclosed, for example, in EP 0 774 363 A1. The disclosure of EP 0 774 363 A1 is incorporated herein by reference. More specifically, composite particles to be used in the present invention are particles in which leuco dye particles are coated with a solid resin or a leuco dye is uniformly dispersed or dissolved in a solid resin.

The average particle diameter of the composite particles is preferably about 0.2 to about 5.0 $\mu$m, more preferably about 1.0 to about 3.0 $\mu$m.

The content of the leuco dye in the composite particles is preferably about 5 to about 70% by weight, more preferably about 15 to about 40% by weight, based on the total weight of the composite particles.

The resin which constitutes the composite particles is not specifically limited and includes, for example, thermoplastic styrene resins, acrylic resins, amide resins, urethane resins, amide-urethane resins, carbonate resins, etc. These resins may be employed alone or as a mixture of two or more. Especially preferred are amide-urethane resins since the use thereof makes it easier to produce composite particles and imparts good resistance to background fogging to the resulting heat-sensitive coloring layer due to excellent heat resistance of said resin.

As composite particles composed of an amide-urethane resin and a leuco dye, preferred are those produced by emulsifying and dispersing in water a solution of a lueco dye (solute) in a polyisocyanate compound (solvent) and then causing a polymerization reaction of the polyisocyanate compound, since they have good heat resistance and therefore are excellent in achieving high resistance to background fogging and easy to produce.

A method for producing composite particles comprises, for example, the steps of dissolving a leuco dye in a polyisocyanate compound serving as a resin-forming material (optionally, containing a polyol compound, a polyamine compound or the like) at a temperature of 60 to 150° C.; cooling the resulting solution if so desired; emulsifying and dispersing the solution in an aqueous media containing as dissolved therein a protective colloid substance such as a polyvinyl alcohol with use of an emulsifier such as a homomixer, an ultrasonic emulsifier, a forced-space-passed mill; adding a reactive substance such as a water soluble polyamine if so desired; and polymerizing the above resin-forming materials to produce composite particles comprising the leuco dye and amide-urethane resin (for example, an amide bond- and urethane bond-containing resin formed by a reaction of an isocyanate compound and water and optionally a polyol or a polyamine).

The proportions of the leuco dye and the polyisocyanate compound are selected in view of better color-forming sensitivity and ease of production, and the polyisocyanate compound is preferably used in an amount of 50 to 2000 parts by weight, more preferably 150 to 600 parts by weight, based on 100 parts by weight of the leuco dye.

The polyisocyanate compound is preferably selected from those which are in the form of a liquid having low viscosity at normal temperatures and which highly dissolve the leuco dye. As such polyisocyanate compounds, particularly preferred are dicyclohexyl-methane-4,4'-diisocyanate, norbornendiisocyanate, hexamethylene diisocyanate, a tris-isocyanulate compound of hexamethylene diisocyanate, etc. because they have low viscosity.

Examples of the polyol compound and the polyamine compound which are optionally added to the polyisocyanate compound acting as solvent are as follows:

Polyol compounds: ethylene glycol, 1,4-butanediol, 1,6-pentanediol, 1,1,1-trimethylolpropane, 1,4-cyclohexanedimethanol, 4,4'-dihydroxydiphenylmethane, etc.

Polyamine compounds: ethylenediamine, trimethylenediamine, hexamethylenediamine, p-phenylenediamine, triethylenetetramine, etc.

The polyol compound, if used, is preferably used in an amount of 100 parts by weight or less, more preferably about 5 to about 50 parts by weight, per 100 parts by weight of the polyisocyanate compound.

The polyamine compound, if used, is preferably used in an amount of 100 parts by weight or less, more preferably about 5 to about 50 parts by weight, per 100 parts by weight of the polyisocyanate compound.

Examples of the water soluble polyamine which is optionally added to a dispersion prepared by emulsifying and dispersing a solution of the leuco dye in the resin-forming material include ethylenediamine, trimethylenediamine, hexamethylenediamine, etc. The water soluble polyamine, if used, is preferably used in an amount of 100 parts by weight or less, more preferably about 5 to about 50 parts by weight, per 100 parts by weight of the polyisocyanate compound.

Microcapsules

The microcapsules containing a leuco dye and a hydrophobic organic solvent can be produced by a known interfacial polymerization or in-situ method. The average particle diameter of the microcapsules is preferably about 0.5 to about 5.0 $\mu$m, more preferably about 1.0 to about 3.0 $\mu$m. As wall-forming material for microcapsules, preferred is an amide-urethane resin (an amide bond- and an urethane bond-containing resin formed by a reaction of an isocyanate compound and water and optionally a polyol or a polyamine) which allows permeation of a developer by the action of heat applied during recording.

The microcapsules can be prepared, for example, by repeating the procedure of preparing the above-mentioned composite particles except that in dissolving a leuco dye in a polyisocyanate compound acting as a resin-forming material, a hydrophobic organic solvent having a boiling point of 100° C. or higher is added thereto in an amount of about 100 to 3000 parts by weight, preferably about 200 to about 2500 parts by weight, per 100 parts by weight of the lueuco dye. The amount of the leuco dye in the microcapsule is from about 3 to about 30 wt. %, preferably from about 3 to about 25 wt. %, based on the total weight of the microcapsule. The amount of the capsule wall is 10 to 2000 parts by weight, preferably 50 to 1000 parts by weight, per 100 parts by weight of the leuco dye.

Examples of the hydrophobic organic solvent include tricresyl phosphate, dibutyl phthalate, dioctyl phthalate, monoisopropylnaphthalene, diisopropylnaphthalene, 1-methyl-1-phenyl-1-tolylmethane, 1-methyl-1-phenyl-1-xylylmethane, etc.

Leuco Dye

As leuco dyes, triarylmethane-based dyes, diarylmethane-based dyes, thiazine-based dyes, spiro-based dyes, lactam-based dyes, fluoran-based dyes, etc. are preferably used. Upon reaction with a developer, each of the leuco dyes forms its own color, including various colors such as black, red, reddish purple, orange, blue, green, yellow, etc.

The leuco dye which forms black color includes, for example, 3-pyrrolidino-6-methyl-7-anilinofluoran, 3-diethylamino-7-(m-trifluoromethylanilino)fluoran, 3-(N-ethyl-p-toluidino)-6-methyl-7-anilinofluoran, 3-diethylamino-6-methyl-7-anilinofluoran, 3-di(n-butyl)amino-6-methyl-7-anilinofluoran, 3-di(n-pentyl)amino-6-methyl-7-anilinofluoran, 3-(N-isoamyl-N-ethylamino)-6-methyl-7-anilinofluoran, 3-di-n-butylamino-7-(2-chloroanilino)fluoran, 3-diethylamino-6-methyl-7-(2,6-dimethylanilino)fluoran, 3-diethylamino-6-methyl-7-(2,4-dimethylanilino)fluoran, 2,4-dimethyl-6-(4-dimethylaminoanilino)fluoran, 3-(N-cyclohexyl-N-methylamino)-6-methyl-7-anilinofluoran and the like.

The leuco dye which forms red color includes, for example, 3,6-bis(diethylamino)fluoran-γ-anilinolactam, 3-dimethylamino-7-bromofluoran, 3-diethylaminofluoran, 3-diethylamino-6-methylfluoran, 3-diethylamino-7-chlorofluoran, 3-diethylamino-7-bromofluoran, 3-diethylamino-7,8-benzofluoran, 3-(N-ethyl-N-tolylamino)-7-methylfluoran, 3-cyclohexylamino-6-chlorofluoran, 3-di(n-butyl)amino-6-methyl-7-bromofluoran, 3-di(n-butyl)amino-7,8-benzofluoran, 2-(N-acetylanilino)-3-methyl-6-di(n-butyl)aminofluoran, 2-(N-benzylanilino)-3-methyl-6-di(n-butyl)aminofluoran, 2-(N-methylanilino)-3-methyl-6-di(n-butyl)aminofluoran, 3-diethylamino-7-phenoxyfluoran, 3-(N-ethyl-N-isoamylamino)-7-phenoxyfluoran, 3,3'-bis(1-n-butyl-2-methylindol-3-yl)phthalide and the like.

The leuco dye which forms blue color includes, for example, 3,3-bis(p-dimethylaminophenyl)-6-dimethylaminophthalide, 3-(4-diethylamino-2-methylphenyl)-3-(4-dimethylaminophenyl)-6-dimethylaminophthalide, 3-(1-ethyl-2-methylindol-3-yl)-3-(4-diethylaminophenyl)-phthalide, 3-(1-ethyl-2-methylindol-3-yl)-3-(2-methyl-4-diethylaminophenyl)-4-azaphthalide, 3-(1-ethyl-2-methylindol-3-yl)-3-(2-ethoxy-4-diethylaminophenyl)-4-azaphthalide, 3-(1-ethyl-2-methylindol-3-yl)-3-(2-n-hexyloxy-4-diethylaminophenyl)-4-azaphthalide, 3-diphenylamino-6-diphenylaminofluoran and the like.

The leuco dye which forms green color includes, for example, 3-(N-ethyl-N-n-hexylamino)-7-anilinofluoran, 3-diethylamino-7-dibenzylaminofluoran, 3,3-bis(4-diethylamino-2-ethoxyphenyl)-4-azaphthalide, 3-(N-ethyl-N-p-tolylamino)-7-(N-phenyl-N-methylamino)fluoran, 3-[p-(p-anilinoanilino)anilino]-6-methyl-7-chlorofluoran, 3,6-bis(dimethylamino)fluorene-9-spiro-3'-(6'-dimethylamino)-phthalide and the like.

The leuco dye which forms yellow color includes, for example, 3,6-dimethoxyfluoran, 1-(4-n-dodecyloxy-3-methoxyphenyl)-2-(2-quinolyl)ethylene and the like.

A multicolor heat-sensitive recording material exhibiting excellent color separation can be produced by incorporating into the heat-sensitive coloring layer either composite particles in which a leuco dye is contained in solid resin particles or microcapsules in which a leuco dye and a hydrophobic organic solvent are contained, and further incorporating into the heat-sensitive coloring layer another leuco dye which forms a color different from that formed by the above leuco dye in the form of composite particles or contained in microcapsules.

When such a multi-color heat-sensitive recording layer, for example, 2-color heat-sensitive recording layer is produced, a first leuco dye which reacts with the specific developer upon application of low energy is subjected to a color forming reaction to thereby form a recorded image (low applied energy recording) and then a second leuco dye which reacts with the specific developer upon application of high energy and forms a color different from the color formed by the first leuco dye is subjected to a color forming reaction to thereby form a recorded image having a color which is made up of a mixture of the colors formed by the first and second leuco dyes (high applied energy recording).

Generally, a leuco dye contained in composite particles or in microcapsules melts and comes into contact with a developer to develop color at a higher temperature, compared with the leuco dye as it is. Accordingly, the first leuco dye is preferably used as it is for the low applied energy recording, while the second leuco dye is preferably used in the form of composite particles or microcapsules for the high applied energy recording. Generally, the first and second leuco dyes are selected such that the first leuco dye forms a color at a temperature of about 80 to about 120° C. and the second leuco dye contained in composite particles or microcapsules forms a color at a temperature which is higher than the color forming temperature of the first leuco dye by 30 to 50° C. The melting points of the leuco dyes are well known, so that the first and second leuco dyes are readily selected by a person skilled in the art.

The ratio of the second leuco dye contained in composite particles or microcapsules to the first leuco dye capable of forming a color different from the color formed from the second leuco dye is not particularly limited, insofar as the ratio is effective for visual distinction between the color formed by either one of these leuco dyes and a mixture of colors formed by the two leuco dyes. Generally, at least one first leuco dye which forms a color different from the color formed by the second leuco dye is preferably used in an amount of about 30 to about 300 parts by weight, particularly in an amount of about 50 to about 200 parts by weight, per 100 parts by weight of the second leuco dye contained in the composite particles or microcapsules.

A combination of the second leuco dye contained in composite particles or microcapsules and the first leuco dye which forms a color different from the color formed by the second leuco dye may be suitably selected in view of the above points. Preferably, the second leuco dye in the composite particles or microcapsules is selected from fluoran dyes which form a black color, and the first leuco dye is selected from fluoran dyes which form a red color.

Developer

The heat-sensitive coloring layer contains the specific developer, namely, N-p-toluenesulfonyl-N'-3-(p-toluenesulfonyloxy)phenylurea to develop the color of the leuco dye by the heat from the thermal head. The developer is represented by the following formula (d):

(d)

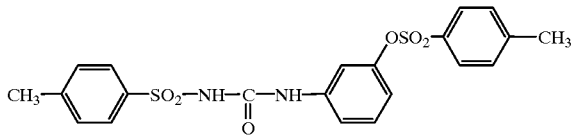

The developer is commercially available from Ciba Specialty Chemicals under the trade name "Pergafast201"

Optional Additives

The heat-sensitive coloring layer of the invention may further contain any of a variety of known developers, as long as they do not lessen the contemplated effects of the invention. Such developers include, for example, 4,4'-dihydroxydiphenylmethane, 4,4'-isopropylidenediphenol, 4,4'-cyclohexylidenediphenol, 1,1-bis(4-hydroxyphenyl)-ethane, 1,1-bis(4-hydroxyphenyl)-1-phenylethane, 4,4'-dihydroxydiphenylsulfone, 2,4'-dihydroxydiphenylsulfone, 4-hydroxy-4'-isopropoxy-diphenylsulfone, benzyl 4-hydroxybenzoate, N,N'-di-m-chlorophenylthiourea, 4,4'-bis(p-tolylsulfonylamino-carbonylamino)diphenylmethane, 4-[2-(p-methoxyphenoxy)-ethyloxy]salicylate, zinc 4-[3-(p-tolylsulfonyl)-propyloxy]salicylate, zinc 5-[p-(2-p-methoxyphenoxy-ethoxy)cumyl]salicylate and the like. Such optional developers, if used, are preferably used in an amount of about 100 parts by weight or less, particularly about 5 to 50 parts by weight, per 100 parts by weight of the specific developer.

For enhancing recording sensitivity and improving preservability of recorded portions, sensitizers and preservability improving agent may be incorporated into the composite particles or the heat-sensitive coloring layer. Each of the sensitizer and the preservability improving agent, if used, is preferably used in an amount of about 3 to about 35 wt. %, more preferably about 5 to about 30 wt. %, based on the total amount of solids in the heat-sensitive coloring layer.

The sensitizer may be any of a wide variety of compounds conventionally used as sensitizers for heat-sensitive recording materials. Such sensitizers include, for example, stearic acid amide, ethylenebisstearamide, p-benzylbiphenyl, dibenzyl terephthalate, 2-naphthyl benzyl ether, di-o-chlorobenzyl adipate, 1,2-diphenoxyethane, 1,2-bis(3-methylphenoxy)ethane, dibenzyl oxalate, di-p-methylbenzyl oxalate, di-p-chlorobenzyl oxalate, 1,2-bis(3,4-dimethylphenyl)ethane, 1,3-bis(2-naphthoxy)propane, m-terphenyl, diphenylsulphone, benzophenone and the like. Expecially preferred is di-p-methylbenzyl oxalate.

Examples of preservability improving agents include compounds of the formula (1) shown below, 1,1,3-tris(2-methyl-4-hydroxy-5-cyclohexylphenyl)butane, 1,1,3-tris(2-methyl-4-hydroxy-5-tert-butylphenyl)butane, 1,3,5-tris(4-tert-butyl-3-hydroxy-2,6-dimethylbenzyl)-isocyanurate, 4-benzyloxyphenyl-4'-(2-methyl-2,3-epoxy-propyloxy) phenylsulfone, 1,1-bis(2-methyl-4-hydroxy-5-tert-butylphenyl)butane, 2,2'-methylenebis(4,6-di-tert-butylphenyl), 4,4'-dihydroxy-3,3',5,5'-tetrabromo-diphenylsulphone, 4-(2-methyl-1,2-epoxyethyl) diphenylsulfone, diglycidyl terephthalate, 4,4'-glycidyloxy-diphenylsulfone and the like.

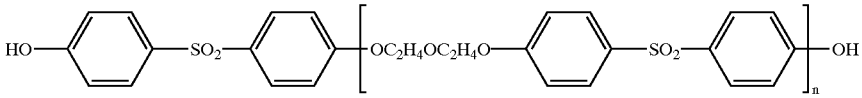

(1)

wherein n is an integer of 1 to 7.

The compounds represented by the formula (1) may be used alone or as a mixture of two or more. When a mixture of two or more compounds of the formula (1) are used, it is preferable that the mixture preferably contains as a main component (at least 30 wt. %, preferably at least 40 wt. % of) a compound of the formula (1) wherein n is 1, and that the total amount of the compounds of the formula (1) wherein n is 1 to 3 is at least 50 wt. %, particularly at least 75 wt. %. The mixture may further contain small amounts of compounds of the formula (1) wherein n is 8 or more and a compound of the formula (1) wherein n is 0.

Of the preservability improving agents, especially preferred are compounds of the formula (1), 1,1,3-tris(2-methyl-4-hydroxy-5-cyclohexylphenyl)butane, 1,1,3-tris(2-methyl-4-hydroxy-5-tert-butylphenyl)butane, 1,3,5-tris(4-tert-butyl-3-hydroxy-2,6-dimethylbenzyl)-isocyanuric acid, and 4-benzyloxyphenyl-4'-(2-methyl-2,3-epoxypropyloxy) phenylsulfone.

When at least one compound of the formula (1) is used in combination with at least one preservability improving agent selected from the group consisting of 1,1,3-tris(2-methyl-4-hydroxy-5-cyclohexylphenyl)butane, 1,1,3-tris(2-methyl-4-hydroxy-5-tert-butylphenyl)butane, 1,3,5-tris(4-tert-butyl-3-hydroxy-2,6-dimethylbenzyl)-isocyanuric acid and 4-benzyloxyphenyl-4'-(2-methyl-2,3-epoxypropyloxy) phenylsulfone, there can be provided a heat-sensitive recording material with especially high preservability in recorded portions over a prolonged period of time and with a particularly high resistance to chemicals. In the case of such combined use, at least one compound of the formula (1) is preferably used in an amount of about 5 to about 300 parts by weight, particularly about 10 to about 150 parts by weight, per 100 parts by weight of said at least one preservability improving agent.

Further, the heat-sensitive coloring layer may contain calcium carbonate, magnesium carbonate, kaolin, clay, talc, calcined clay, amorphous silica, diatomaceous earth, synthetic aluminum silicate, zinc oxide, titanium oxide, aluminum hydroxide, barium sulfate, urea-formalin resin fillers and like inorganic or organic pigments (prepferably having an avarage particle diameter of 5 $\mu$m or less); dimethylolurea, glyoxal, polyamide-epichlorohydrin resin, boric acid, borax and like insolubilizers; paraffin wax, carnauba wax, microcrystalline wax, polyolefin wax and polyethylene wax; zinc stearate, calcium stearate and like lubricants; colored dyes, colored pigments, fluorescent dyes and the like.

Heat-sensitive Coloring Layer

The heat-sensitive coloring layer can be formed, for example, by a process comprising the steps of mixing and stirring, in water as a medium, the aforementioned composite particles or microcapsules, a binder and optionally any of the aforementioned additives (e.g., sensitizers, pigments, lubricants) to prepare a coating composition for forming a heat-sensitive recording layer; applying the coating composition to a support in a coating amount of about 2 to 15 g/m$^2$, preferably 4 to 10 g/m$^2$, on a dry weight basis; and drying the coating.

Binders usable in the coating composition for forming a heat sensitve coloring layer include, for example, polyvinyl alcohols and derivatives thereof, starch and derivatives thereof, hydroxy-methylcellulose, hydroxy-ethylcellulose, hydroxy-propylcellulose, methylcellulose, ethylcellulose and like cellulose derivatives; polyvinylpyrrolidone, acrylamide-acrylate copolymers, acrylamide-acrylate-methacrylate copolymers, styrene-maleic anhydride copolymers, isobutylene-maleic anhydride copolymers, casein, gelatine and like water-soluble binders; vinyl acetate-based latex, urethane-based latex, acrylic latex, styrene-butadiene-based latex and the like.

The binder is preferably used in an amount of about 5 to about 40% by weight, particularly about 10 to about 35% by weight, based on the total amount of solids in the heat-sensitive coloring layer.

The heat-sensitive coloring layer may have a multilayer structure in which a plurality of leuco dyes are contained in the respective layers or may have a single-layer structure which contains a plurality of leuco dyes in one layer.

The method for applying the coating composition for forming a heat-sensitive coloring layer is not particularly limited. Useful methods include, for example, air knife coating, blade coating, die coating, curtain coating, slide bead coating and the like.

Support

The support on which the heat-sensitive recording layer is formed is not particularly limited with respect to the material, shape and dimension. For example, the support may be suitably selected from wood-free paper (acidic paper, neutralized paper), mechanical paper, coated paper, art paper, cast-coated paper, glassine paper, resin laminated paper, polyolefin-based synthetic paper, synthetic fiber paper, nonwoven fabric, synthetic resin film, as well as various transparent supports. The thickness of the support may be in the range of about 40–200 $\mu$m.

When the heat-sensitive recording material of the present invention is used for magnetic tickets, paper is preferably used. When the heat-sensitive recording material of the present invention is used for prepaid cards or magnetic season tickets, plastic supports made of polyethylene terephthalate having a thickness of about 80–200 $\mu$m may be used. Foamed polyethylene terephthalate film is especially effective for enhancing heat-sensitivity. Of course, a laminate support comprising foamed polyethylene terephthalate and unfoamed polyethylene terephthalate may also be used.

Protective Layer

For improving runnability during recording, preservation of recorded portions against chemicals and transparency, it is preferable to form on the heat-sensitive coloring layer a protective layer containing as a main component an organic high-molecular-weight compound which excels in film forming ability.

The protective layer can be formed, for example, by a process comprising the steps of mixing and stirring an aqueous solution of an organic high-molecular-weight compound having an excellent film forming ability and at least one of the auxiliary agents which can be added to a coating composition for forming a heat-sensitive coloring layer (especially, the aforementioned inorganic or organic pigments, etc.) to prepare a coating composition for forming a protective layer; applying the coating composition to the heat-sensitive coloring layer in a coating amount of about 1 to about 6 g/m$^2$, preferably about 1 to about 4 g/m$^2$, on a dry weight basis; and drying the coating.

In the above process, the organic high-molecular-weight compound having an excellent film forming ability may be, for example, a partially or completely saponified polyvinyl alcohol, a carboxy-modified polyvinyl alcohol, an acetoacetyl-modified polyvinyl alcohol, a silicon-modified polyvinyl alcohol, gelatine, casein or the like.

The method for applying the coating composition for forming a protective layers is not particularly limited. Useful methods include, for example, air knife coating, blade coating, die coating, curtain coating, slide bead coating and the like.

The heat-sensitive recording material of the present invention may be modified by utilizing a variety of techniques conventionally used in the production of heat-sensitive recording materials. Such modifications include the following modifications: a magnetic recording layer is formed on the rear side of a support on which a heat-sensitive coloring layer is not formed, or formed between a support and a heat-sensitive coloring layer; an undercoat layer containing as main component an oil absorbing pigment or hollow organic particles and a binder is formed between a support and a heat-sensitive coloring layer; printing with an ink such as UV ink or flexographic ink is provided; an adhesive layer is formed on the rear side of a support on which a heat-sensitive coloring layer is not formed; after forming each layer, a known smoothing treatment is carried out using a super calender, a soft calender or like technique for smoothing.

For example, when an undercoat layer is formed between a support and a heat-sensitive recording layer for enhancing recording sensitivity, the undercoat layer may be formed by a process comprising the steps of suspending an oil absorbing pigment or hollow organic particles and a binder in water to prepare a coating composition for forming an undercoat layer; applying the coating composition to the support; and drying the coating. Preferred oil absorbing pigments are calcium carbonate, amorphous silica, calcinated kaolin and magnesium carbonate, each having an oil absorption of about 70 to about 300 ml/100 g as measured according to the method of JIS K 5101. Examples of hollow organic particles are those having the following properties: the shell is made of a synthetic resin such as styrenic resin, vinylidine chloride resin or acrylic resin; the average particle diameter is about 0.51 to about 20 $\mu$m, preferably about 1 to about 10 $\mu$m; hollowness (inside diameter/outer diameter×100) is about 70 to about 98%. The amount of the binder may be selected from a wide range. The binder is usually used in an amount of about 5 to about 30 parts by weight, particularly 8 to 20 parts by weight, per 100 parts by weight of the oil absorbing pigment or hollow organic particles.

A coating composition for forming an undercoat layer is applied in a coating amount of about 3 to about 15 g/m$^2$, preferably about 3 to about 10 g/m$^2$, on a dry weight basis. The method of applying the composition for forming an undercoat layer may be similar to the method of applying the coating composition for forming a heat-sensitive coloring layer.

Further, for improving surface gloss or water resistance, an uppermost layer may be formed on a heat-sensitive recording layer or a protective layer by applying a coating composition for forming such an uppermost layer containing as a main component an electron beam- or ultraviolet ray-curable compound in a coating amount of 0.5 to 10 g/m$^2$, followed by irradiation of electron beam or ultraviolet ray to cure the coating. Electron beam-curable compounds are described in Japanese Unexamined Patnent Publication No. 177392/1983, etc. The coating composition for forming an uppermost layer may contain additives such as resins other than the electron beam curable resins, pigments and anti-foaming agents, levelling agents, lubricants, surfactants and plasticizers. Especially, pigments such as calcium carbonate, aluminum hydroxide and kaolin, and lublicants such as waxes and silicone are effective for preventing the phenomenon of sticking to the thermal head, thus being preferable.

EXAMPLES

The present invention will be described further in detail referring to Examples below. However, the present invention is not limited by these Examples. In these Examples, all parts and percentages are by weight unless otherwise stated.

Example 1

Preparation of a Dispersion of Composite Fine Particles Containing Leuco Dye Providing Black Color As a leuco dye providing black color, 8 parts of 3-di(n-amyl)amino-6-methyl-7-anilinofluoran was dissolved in 24 parts of dicyclohexylmethane-4,4'-diisocyanate heated to 100° C. The resulting solution was cooled to 25° C., and then was gradually added to 100 parts of an 8% aqueous solution of polyvinyl alcohol (GOSENOL GM-14L, produced by The Nippon Synthetic Chemical Industry Co.,Ltd.) at the same temperature. The mixture was stirred using TK homomixer (model HV-M, produced by TOKUSHU KIKA KOGYO KABUSHIKI KAISHA) at 5000 rpm to prepare an emulsion. To this emulsion was added 28 parts of water, followed by mixing uniformly. The resulting emulsion was heated to 80° C. to cause curing reaction for 10 hours, giving a dispersion of composite fine particles containing a leuco dye providing black color and having an average particle diameter of 1.1 $\mu$m (with water added after reaction as much as is need to adjust the solid content to 25%).

Preparation of a Dispersion of a Leuco Dye Providing Red Color

A composition comprising 40 parts of 3-(N-ethyl-N-isoamylamino)-7-phenoxyfluoran as a leuco dye providing red color, 40 parts of a 10% aqueous solution of sulfone-modified polyvinyl alcohol and 20 parts of water was pulverized with a vertical sand mill (sand grinder, produced by Aymex) until an average particle diameter of 1.0 $\mu$m was attained, giving a dispersion of a leuco dye providing red color.

Preparation of a Dispersion of a Developer

A composition comprising 40 parts of N-p-toluenesulfonyl-N'-3-(p-toluenesulfonyloxy)phenylurea (product name: Pergafast 201, produced by Ciba Specialty Chemicals) as a developer, 40 parts of a 10% aqueous solution of sulfone-modified polyvinyl alcohol and 20 parts of water was pulverized with a vertical sand mill (Sand Grinder, produced by Aymex) until an average particle diameter of 1.0 $\mu$m was attained, giving a dispersion of a developer.

Preparation of a Dispersion of a Sensitizer

A composition comprising 40 parts of a sensitizer (di-p-methylbenzyl oxalate), 40 parts of a 10% aqueous solution of sulfone-modified polyvinyl alcohol and 20 parts of water was pulverized with a vertical sand mill (Sand Grinder, produced by Aymex) until an average particle diameter of 1.0 $\mu$m was attained, giving a dispersion of a sensitizer.

Preparation of a Dispersion of a Preservability Improving Agent

A composition comprising 25 parts of a compound represented by the foregoing formula (1) (product name: D-90, total content of the compounds of the formula (1) wherein n is 1–7 is 87 wt. %, produced by NIPPON SODA CO., LTD.), 15 parts of 1,3,5-tris(4-tert-butyl-3-hydroxy-2,6-dimethylbenzyl)isocyanuric acid, 40 parts of a 10% aqueous solution of sulfone-modified polyvinyl alcohol and 20 parts of water was pulverized with a vertical sand mill (Sand Grinder, produced by Aymex) until an average particle diameter of 1.0 μm was attained, giving a dispersion of a preservability improving agent.

Preparation of a Coating Composition for Protective Layer

A composition comprising 50 parts of aluminum hydroxide (Higilite H-42, produced by Showa Keikinzoku Kogyo Kabushiki Kaisha), 5 parts of a 10% aqueous solution of sodium polyacrylate (dispersant), 50 parts of a 21% aqueous dispersion of zinc stearate (Z-7, produced by Chukyo Yushi Kabushiki Kaisha), 400 parts of a 10% aqueous solution of carboxy-modified polyvinyl alcohol and 100 parts of water was mixed and stirred, giving a coating composition for a protective layer.

Preparation of a Coating Composition for Heat-sensitive Coloring Layer

A composition comprising 80 parts of the dispersion of composite fine particles containing a leuco dye providing black color, 15 parts of the dispersion of the leuco dye providing red color, 75 parts of the dispersion of the developer, 30 parts of the dispersion liquid of the sensitizer, 40 parts of the dispersion liquid of the preservability improving agent, 10 parts of a 50% dispersion liquid of a precipitated calcium carbonate, 20 parts of a 21% aqueous dispersion of zinc stearate (Z-7, produced by Chukyo Yushi Kabushiki Kaisha) and 40 parts of a 10% aqueous solution of polyvinyl alcohol was mixed and stirred, giving a coating composition for a heat-sensitive coloring layer.

Preparation of a Coating Composition for Undercoat Layer

A composition comprising 80 parts of calcined kaolin (Ansilex, produced by Engelhard Corporation), 6 parts of precipitated calcium carbonate, 5 parts of a 10% aqueous solution of sodium polyacrylate (dispersant), 20 parts of a 21% aqueous dispersion of zinc stearate (Z-7, produced by Chukyo Yushi Kabushiki Kaisha), 50 parts of a 10% aqueous solution of polyvinyl alcohol (NM11Q, produced by The Nippon Synthetic Chemical Industry Co.,Ltd.), 14 parts of styrene-butadiene latex (solid content: 50%) and 150 parts of water was mixed and stirred, giving a coating composition for an undercoat layer.

Preparation of Heat-sensitive Recording Material

The coating composition for undercoat layer was applied to a sheet of wood free paper (neutralized paper) weighing 60 g/m$^2$ in an amount of 10 g/m$^2$ on a dry weight basis and dried to form an undercoat layer, to which the coating composition for heat-sensitive recording layer was applied in an amount of 7 g/m$^2$ on a dry weight basis and dried to form a heat-sensitive recording layer, to which the coating composition for protective layer was applied in an amount of 3 g/m$^2$ on a dry weight basis and dried, thereby preparing a heat-sensitive recording material comprising the undercoat layer, the heat-sensitive recording layer and the protective layer. Each of the above layers, when formed, was subjected to a super-calender treatment, and the resulting heat-sensitive recording material had a Bekk smoothness (JIS P 8119) of $1.2\times10^3$ seconds on its protective layer side.

Example 2

A heat-sensitive recording material was prepared in the same manner as in Example 1 except that the coating composition for heat-sensitive recording layer was prepared by using 80 parts of a dispersion of the following microcapsules encapsulating a leuco dye providing black color in place of 80 parts of the dispersion of the composite fine particles containing a leuco dye providing black color.

Preparation of Microcapsules Encapsulating a Leuco Dye Providing Black Color

As a leuco dye providing black color, 8 parts of 3-di(n-amyl)amino-6-methyl-7-anilinofluoran was dissolved in 18 parts of a mixture of mono- and diisopropylnaphthalene heated to 100° C. To the resulting solution was added 6 parts of dicyclohexylmethane-4,4'-diisocyanate. The resulting solution was gradually added to 100 parts of an 8% aqueous solution of polyvinyl alcohol (produced by The Nippon Synthetic Chemical Industry Co., Ltd., trade name: GOSENOL GM-14L). The resulting mixture was stirred with TK homomixer (model HV-M, produced by TOKUSHU KIKA KOGYO KABUSHIKI KAISHA) at 5000 rpm to produce an emulsion. To this emulsion was added 20 parts of water, followed by mixing uniformly. This emulsion was heated to 80° C. to cause curing reaction for 10 hours, giving a dispersion of microcapsules having an average particle diameter of 1.2 μm and encapsulating a leuco dye (with water added as much as is needed to adjust the solid content to 25% after the reaction).

Example 3

A heat-sensitive recording material was prepared in the same manner as in Example 1 except that the coating composition for preservability improving agent was prepared by using 15 parts of 1,1,3-tris(2-methyl-4-hydroxy-5-cyclohexylphenyl)butane in place of 15 parts of 1,3,5-tris(4-tert-butyl-3-hydroxy-2,6-dimethylbenzyl)isocyanuric acid.

Example 4

A heat-sensitive recording material was prepared in the same manner as in Example 1 except that the coating composition for a preservability improving agent was prepared by using 15 parts of 1,1,3-tris(2-methyl-4-hydroxy-5-tert-butylphenyl)butane in place of 15 parts of 1,3,5-tris(4-tert-butyl-3-hydroxy-2,6-dimethylbenzyl)isocyanuric acid.

Example 5

A heat-sensitive recording material was prepared in the same manner as in Example 1 except that the coating composition for a preservability improving agent was prepared by using 15 parts of 4-benzyloxyphenyl-4'-(2-methyl-2,3-epoxypropyloxy)phenylsulfone in place of 15 parts of 1,3,5-tris(4-tert-butyl-3-hydroxy-2,6-dimethylbenzyl) isocyanuric acid.

Example 6

A heat-sensitive recording material was prepared in the same manner as in Example 1 except that the coating composition for heat-sensitive recording layer was prepared by using 80 parts of a 20% dispersion of stearic acid amide having an average particle diameter of 0.8 μm in place of 40 parts of the coating composition for preservability improving agent.

Example 7

A heat-sensitive recording material was prepared in the same manner as in Example 1 except that the dispersion of the sensitizer was prepared by using 20 parts of 1,2-diphenoxyethane and 20 parts of 1,2-bis(3-methylphenoxy) ethane in place of 40 parts of di-p-methylbenzyl oxalate.

Comparative Example 1

A heat-sensitive recording material was prepared in the same manner as in Example 1 except that the coating composition for the heat-sensitive recording layer was prepared by using 20 parts of the following dispersion of a leuco dye providing black color and 80 parts of a 10% aqueous solution of polyvinyl alcohol (saponification degree: 80%, polymerization degree: 1000) in place of 80 parts of a dispersion of composite fine particles containing leuco dye providing black color.

Preparation of Dispersion of Leuco Dye Providing Black Color

A dispersion of a leuco dye providing black color was prepared by pulverizing a composition comprising 40 parts of 3-di(n-amyl)amino-6-methyl-7-anilinofluoran as a leuco dye providing black color, 40 parts of a 10% aqueous solution of sulfone-modified polyvinyl alcohol and 20 parts of water with a vertical sand mill (Sand Grinder, produced by Aymex) until an average particle diameter of 1.0 $\mu$m was attained.

Comparative Example 2

A heat-sensitive recording material was prepared in the same manner as in Example 1 except that the dispersion liquid of the developer was prepared by using 4,4'-dihydroxydiphenylsulfone in place of N-p-toluenesulfonyl-N'-3-(p-toluenesulfonyloxy)phenylurea.

Test Example 1

The thus-obtained heat-sensitive recording materials were evaluated for the properties mentioned below. The results are shown in Table 1.

Color Forming Property

A thermosensitive printing tester (trade name: TH-PMD, produced by Okura Denki Kabushiki Kaisha) was used to form a solid print image consisting of 256 lines to give a red color record image by low applied energy recording under the following conditions: one line recording time=5 m sec, sub-scanning line density=8 lines/mm, applied energy per dot=0.5 mJ. Meanwhile, another solid print image consisting of 256 lines was formed to give black color image by a high applied energy recording under the following conditions: one line recording time=5 m sec, sub-scanning line density=8 lines/mm, applied energy per dot=2.0 mJ. The color density of the recorded portions was determined with Macbeth densitometer (Model 914, manufactured by Macbeth).

Color Separation Property

The recorded portions formed by the low applied energy recording and the recorded portions formed by the high applied energy recording in the above evaluation of the color forming property were visually evaluated for their color separation property according to the following criteria.

○: Recorded portion formed by low applied energy recording had a vivid red color.

× Recorded portion formed by low applied energy recording had a reddish black color.

Preservability of Recorded Portion (Oil Resistance)

A drop of salad oil was applied to the protective layer on the recorded portion formed by subjecting the heat-sensitive recording materials to high applied energy recording in the above evaluation of color-forming property. The recording materials were left to stand at 20° C. for 24 hours, and were visually evaluated for the degree of fading of the recorded portion.

◎: Substantially no fading of recorded portion observed.

○: Fading of the recorded portion was observed, but the record images were legible.

× Recorded portion faded and the record images were not legible.

Resistance to Background Fogging

The heat-sensitive recording materials were stored in an environment maintained at a temperature of 55° C. and relative humidity of 90% for 100 hours and then were measured for their whiteness of the background (Hunter whiteness, JIS P 8123) (treated sample). Further, the heat-sensitive recording materials which were not exposed to the above environment were also measured for their whiteness (untreated sample). The results are shown in Table 1.

The whiteness value of 75 or higher is satisfactory for practical use, whereas the whiteness value of 70 or lower may give unclean impression.

TABLE 1

| | Color-forming property | | Color separa- | | Background fogging resistance | |
|---|---|---|---|---|---|---|
| | Red-colored portion | Black-colored portion | tion property | Oil resistance | Un-treated sample | treated sample |
| Ex. 1 | 0.83 | 1.35 | ○ | ◎ | 84 | 77 |
| Ex. 2 | 0.82 | 1.33 | ○ | ◎ | 84 | 77 |
| Ex. 3 | 0.83 | 1.34 | ○ | ◎ | 84 | 76 |
| Ex. 4 | 0.83 | 1.35 | ○ | ◎ | 84 | 76 |
| Ex. 5 | 0.83 | 1.35 | ○ | ◎ | 84 | 75 |
| Ex. 6 | 0.84 | 1.34 | ○ | ○ | 84 | 75 |
| Ex. 7 | 0.86 | 1.37 | ○ | ◎ | 85 | 77 |
| Comp. Ex. 1 | 1.30 | 1.34 | x | ○ | 84 | 70 |
| Comp. Ex. 2 | 0.69 | 1.28 | x | x | 84 | 63 |

EFFECTS OF THE INVENTION

The heat-sensitive recording material of the present invention has excellent effects in terms of the preservability of recorded portions and resistance to background fogging, and also in terms of color separation property.

What is claimed is:

1. A heat-sensitive recording material which comprises a support and a heat-sensitive coloring layer formed on the support and containing a leuco dye and a developer, the leuco dye being either (i) in the for of composite particles each of which contains the leuco dye i a solid resin particle or (ii) contained in microcapsules in which a hydrophobic organic solvent is contained, the developer being N-p-toluenesulfonyl-N'-3-(p-toluenesulfonyloxy) phenylurea, and the heat-sensitive coloring layer further containing a preservability improving agent, the preservability improving agent being a mixture of (a) at least one member selected from the group consisting of 1,1,3-tris(2-methyl-4-hydroxy-5-cyclohexylphenyl)butane, 1,1,3-tris(2-methyl-4-hydroxy-5-tert-butylphenyl)butane, 1,3,5-tris(4-tert-butyl-3-hydroxy-2, 6-dimethylbenzyl)-isocyanuric acid, and 4-benzyloxyphenyl-4'-(2-methyl-2, 3-epoxypropyloxy) phenyl sulfone, and (b) at least one compound represented by the following formula (1)

(1)

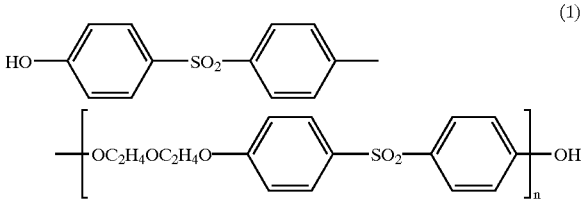

wherein n is an integer of 1 to 7.

2. The heat-sensitive recording material according to claim 1, wherein the composite particles or microcapsules are present in an amount of 5 to 70% y weight, based on the total amount of solids in the heat-sensitive coloring layer, and N-p-toluenesulfonyl-N'-3-(p-toluenesulfonylox) phenylurea is present in an amount of 5 to 60% by weight, bas d on the total amount of solids in the heat-sensitive coloring layer.

3. The heat-sensitive recording material according to claim 1, wherein the composite particles have an average particle diameter of about 0.2 to about 5 $\mu$m.

4. The heat-sensitive recording material according to claim 1, wherein the composite particles are constituted by at least one resin selected from the group consisting of thermoplastic styrene resins, acrylic resins, amide resins, urethane resins, amide-urethane resins and carbonate resins.

5. The heat-sensitive recording material according to claim 1, wherein the composite particles are constituted by an amide-urethane resin.

6. The heat-sensitive recording material according to claim 1, wherein the composite particles are produced by emulsifying and dispersing in water a solution of a leuco dye as a solute in a polyisocyanate compound as a solvent, and subjecting the aqueous emulsion to a polymerization reaction of the polyisocyanate compound.

7. The heat-sensitive recording material according to claim 1, wherein the composite particles are produced by a process comprising the steps of dissolving the leuco dye in a resin-forming material comprising a polyisocyanate compound or a mixture of a polyisocyanate compound and at least one member selected from the group consisting of polyol compounds and polyamine compounds at a temperature of 60 to 150° C.; cooling the resulting solution if so desired; emulsifying and dispersing the solution in an aqueous media containing as dissolved therein a protective colloid substance; adding a water soluble polyamine if so desired; and subjecting the resulting dispersion to a polymerization reaction of the resin-forming material.

8. The heat-sensitive recording material according to claim 7, wherein the polyisocyanate compound is used in an amount of 50 to 2000 parts by weight, per 100 parts by weight of the leuco dye.

9. The heat-sensitive recording material according to claim 7, wherein the polyisocyanate compound is dicyclohexylmethane-4,4'-diisocyanate, norbornendiisocyanate, hexamethylene diisocyanate or a tris-isocyanulate compound of hexamethylene diisocyanate.

10. The heat-sensitive recording material according to claim 1, wherein the microcapsules containing the leuco dye and a hydrophobic organic solvent have an average particle diameter of about 0.5 to about 5.0 $\mu$m.

11. The heat-sensitive recording material according to claim 1, wherein leuco dye content of the microcapsules is about 3 to about 30% by weight based on the weight of the microcapsule.

12. The heat-sensitive recording material according to claim 1, wherein the hydrophobic organic solvent is tricresyl phosphate, dibutyl phthalate, dioctyl phthalate, monoisopropylnaphthalene, diisopropylnaphthalene, 1-methyl-1-phenyl-1-tolylmethane or 1-methyl-1-phenyl-1-xylylmethane.

13. The heat-sensitive recording material according to claim 1, wherein at least one compound of the formula (1) is used in an amount of about 5 to about 300 parts by weight per 100 parts by weight of said at least one preservability improving agent.

14. The heat-sensitive recording material according to claim 1, wherein the preservability improving agent is present in an amount of about 3 to about 35% by weight, based on the total amount of solids in the heat-sensitive coloring layer.

15. The heat-sensitive recording material according to claim 1, wherein the heat-sensitive coloring layer further contains a sensitizer, the sensitizer being stearic acid amide, ethylenebisstearamide, p-benzylbiphenyl, dibenzyl terephthalate, 2-naphthyl benzyl ether, di-o-chlorobenzyl adipate, 1, 2-diphenoxyethane, 1, 2-bis (3-methylphenoxy) ethane, dibenzyl oxalate, di-p-methylbenzyl oxalate, di-p-chlorobenzyl oxalate, 1,2-bis(3,4-dimethylphenyl)ethane, 1,3-bis (2-naphthoxy)-propane, m-terphenyl, diphenylsulfone or benzophenone.

16. The heat-sensitive recording material according to claim 15, wherein the sensitizer is present in an amount of 3 to 35% by weight, based on the total amount of solids in heat-sensitive coloring layer.

17. The heat-sensitive recording material according to any one of claims 1 to 16, wherein the heat-sensitive coloring layer further contains a leuco dye which forms a color different from the color formed by the leuco dye contained in the composite particles or in the microcapsules.

18. The heat-sensitive recording material according to claim 1 which further comprises a protective layer.

19. The heat-sensitive recording material according to claim 1 which further comprises an undercoat layer.

* * * * *